US006474781B1

(12) United States Patent
Jeanmaire

(10) Patent No.: US 6,474,781 B1
(45) Date of Patent: Nov. 5, 2002

(54) CONTINUOUS INK-JET PRINTING METHOD AND APPARATUS WITH NOZZLE CLUSTERS

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/861,692

(22) Filed: May 21, 2001

(51) Int. Cl.[7] ..... B41J 2/105
(52) U.S. Cl. ..... 347/47
(58) Field of Search ..... 347/74, 75, 77, 347/82

(56) References Cited

U.S. PATENT DOCUMENTS

| | | | | | |
|---|---|---|---|---|---|
| 1,941,001 | A | | 12/1933 | Hansell | 178/96 |
| 3,373,437 | A | | 3/1968 | Sweet et al. | 347/74 |
| 3,416,153 | A | | 12/1968 | Hertz et al. | 347/73 |
| 3,709,432 | A | | 1/1973 | Robertson | 239/4 |
| 3,878,519 | A | | 4/1975 | Eaton | 347/75 |
| 4,077,040 | A | * | 2/1978 | Hendriks | 347/78 |
| 4,190,844 | A | | 2/1980 | Taylor | 347/82 |
| 4,346,387 | A | | 8/1982 | Hertz | 347/75 |
| 4,638,382 | A | | 1/1987 | Sochor | 360/68 |
| 4,914,522 | A | | 4/1990 | Duffield et al. | 358/296 |
| 5,224,843 | A | | 7/1993 | van Lintel | 417/413 |
| 5,621,443 | A | * | 4/1997 | Buschulte et al. | 347/73 |
| 6,079,821 | A | | 6/2000 | Chwalek et al. | 347/82 |
| 6,220,693 | B1 | * | 4/2001 | Bode et al. | 347/34 |

* cited by examiner

*Primary Examiner*—Anh T. N. Vo
(74) *Attorney, Agent, or Firm*—Milton S. Sales

(57) ABSTRACT

An apparatus for printing an image is provided. The apparatus includes an ink droplet forming mechanism operable to selectively create a stream of ink droplets having a plurality of volumes, a means for selectively obtaining droplet coalescence between adjacent droplet streams, and a droplet deflector having a gas source. The ink droplet producing mechanism has at least one physical grouping of nozzles and includes heater positioned proximate to the nozzles. The nozzles in a group are activated in a substantially identical manner. The gas source is positioned at an angle with respect to the stream of ink droplets and is operable to interact with the stream of ink droplets thereby separating ink droplets having one of the plurality of volumes from ink droplets having another of the plurality of volumes. The heater may be selectively actuated at a plurality of frequencies to create the stream of ink droplets having the plurality of volumes. By selectively causing coalescence between drops originating from different nozzles to occur, larger separations of printing and non-printing droplet streams can be obtained.

15 Claims, 6 Drawing Sheets

CONTINUOUS INK-JET PRINTING METHOD AND APPARATUS WITH NOZZLE CLUSTERS

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color ink jet printing capability is accomplished by one of two technologies. Both require independent ink supplies for each of the colors of ink provided. Ink is fed through channels formed in the print head. Each channel includes a nozzle from which droplets of ink are selectively extruded and deposited upon a receiving medium. Typically, each technology requires separate ink delivery systems for each ink color used in printing. Ordinarily, the three primary subtractive colors, i.e. cyan, yellow and magenta, are used because these colors can produce, in general, up to several million perceived color combinations.

The first technology, commonly referred to as "drop-on-demand" ink jet printing, typically provides ink droplets for impact upon a recording surface using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

Piezoelectric actuators, such as that disclosed in U.S. Pat. No. 5,224,843, issued to vanLintel, on Jul. 6, 1993, have a piezoelectric crystal in an ink fluid channel that flexes when an electric current flows through it forcing an ink droplet out of a nozzle. The most commonly produced piezoelectric materials are ceramics, such as lead zirconate titanate, barium titanate, lead titanate, and lead metaniobate.

In U.S. Pat. No. 4,914,522, which issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an inkcapturing mechanism (often referred to as catcher, interceptor, or gutter). When print is desired, the ink droplets are directed to strike a print media.

Typically, continuous ink jet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,416,153, issued to Hertz et al. on Oct. 6, 1963, discloses a method of achieving variable optical density of printed spots in continuous ink jet printing using the electrostatic dispersion of a charged droplet stream to modulate the number of droplets which pass through a small aperture.

U.S. Pat. No. 3,878,519, issued to Eaton on Apr. 15, 1975, discloses a method and apparatus for synchronizing droplet formation in a liquid stream using electrostatic deflection by a charging tunnel and deflection plates.

U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, issued to Drake et al. on Jan. 20, 1987, discloses a continuous ink jet print head that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet print heads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous ink jet printer having a first pneumatic deflector for deflecting non-printed ink droplets to a catcher and a second pneumatic deflector for oscillating printed ink droplets. A print head supplies a filament of working fluid that breaks into individual ink droplets. The ink droplets are then selectively deflected by a first pneumatic deflector, a second pneumatic deflector, or both. The first pneumatic deflector is an "on/off" type having a diaphragm that either opens or closes a nozzle depending on one of two distinct electrical signals received from a central control unit. This determines whether the ink droplet is to be printed or non-printed. The second pneumatic deflector is a continuous type having a diaphragm that varies the amount that a nozzle is open, depending on a varying electrical signal received the central control unit. This oscillates printed ink droplets so that characters may be printed one character at a time. If only the first pneumatic deflector is used, characters are created one line at a time, being built up by repeated traverses of the print head.

While this method does not rely on electrostatic means to affect the trajectory of droplets, it does rely on the precise control and timing of the first ("ON/OFF") pneumatic deflector to create printed and non-printed ink droplets. Such a system is difficult to manufacture and accurately control, resulting in at least the ink droplet build up discussed above. Furthermore, the physical separation or amount of discrimination between the two droplet paths is erratic due to the precise timing requirements, increasing the difficulty of controlling printed and non-printed ink droplets and resulting in poor ink droplet trajectory control.

Additionally, using two pneumatic deflectors complicates construction of the print head and requires more components. The additional components and complicated structure require large spatial volumes between the print head and the media, increasing the ink droplet trajectory distance. Increasing the distance of the droplet trajectory decreases droplet placement accuracy and affects the print image quality. Again, there is a need to minimize the distance that the droplet must travel before striking the print media in order to insure high quality images. Pneumatic operation requiring the air flows to be turned on and off is necessarily slow, in that an inordinate amount of time is needed to perform the mechanical actuation as well as time associated with the settling any transients in the air flow.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher.

While the ink jet printer disclosed in Chwalek et al. works extremely well for its intended purpose, using a heater to create and deflect ink droplets increases the energy and power requirements of this device.

The use of an air stream has been proposed to separate ink drops of a plurality of volumes into spatially differing trajectories. Non-imaging droplets, having one grouping of volumes, is not permitted to reach the image receiver, while imaging droplets having a significantly different range of volumes are permitted to make recording marks on the receiver. While print heads employing such technology work well for a wide range of inks, there are inks which have fluid properties (e.g. surface tension, viscosity, etc.), under certain operating conditions of ink pressure and drop velocities, such that the maximum ratio of small drops to large drops is not large enough to obtain adequate separation between imaging and non-imaging droplet paths.

Thus, there is a opportunity to provide a modified ink jet print head and printer of simple construction having simple control of individual ink droplets with an increased amount of physical separation between printed and non-printed ink droplets, while retaining the low energy and power consumption advantage of the printing method described above.

SUMMARY OF THE INVENTION

An object of the present invention is to extend the range of ink properties that can be accommodated in a continuous ink jet print head.

Another object of the present invention is to increase the amount of physical separation between ink droplets of a printed ink droplet path and ink droplets of a non-printed ink droplet path.

Yet another object of the present invention is to improve the capability of a continuous ink jet print head for rendering images using a large volume of ink.

Still another object of the present invention is to simplify construction and operation of a continuous ink jet printer suitable for printing with a wide variety of inks including aqueous and non-aqueous solvent inks containing pigments and/or dyes on a wide variety of receiving media, including paper, vinyl, cloth and other large fibrous materials.

According to a feature of the present invention, an apparatus for printing an image includes an ink droplet forming mechanism operable to selectively create a stream of ink droplets having a plurality of volumes. A physical grouping of nozzles on the print head allows ink droplets originating from different nozzles within the group to coalesce under certain operating conditions thus extending the range of drop volumes that can be generated. Additionally, a droplet deflector having a gas source is positioned at an angle with respect to the stream of ink droplets and is operable to interact with the stream of ink droplets. The interaction separates ink droplets having one volume from ink droplets having other volumes.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
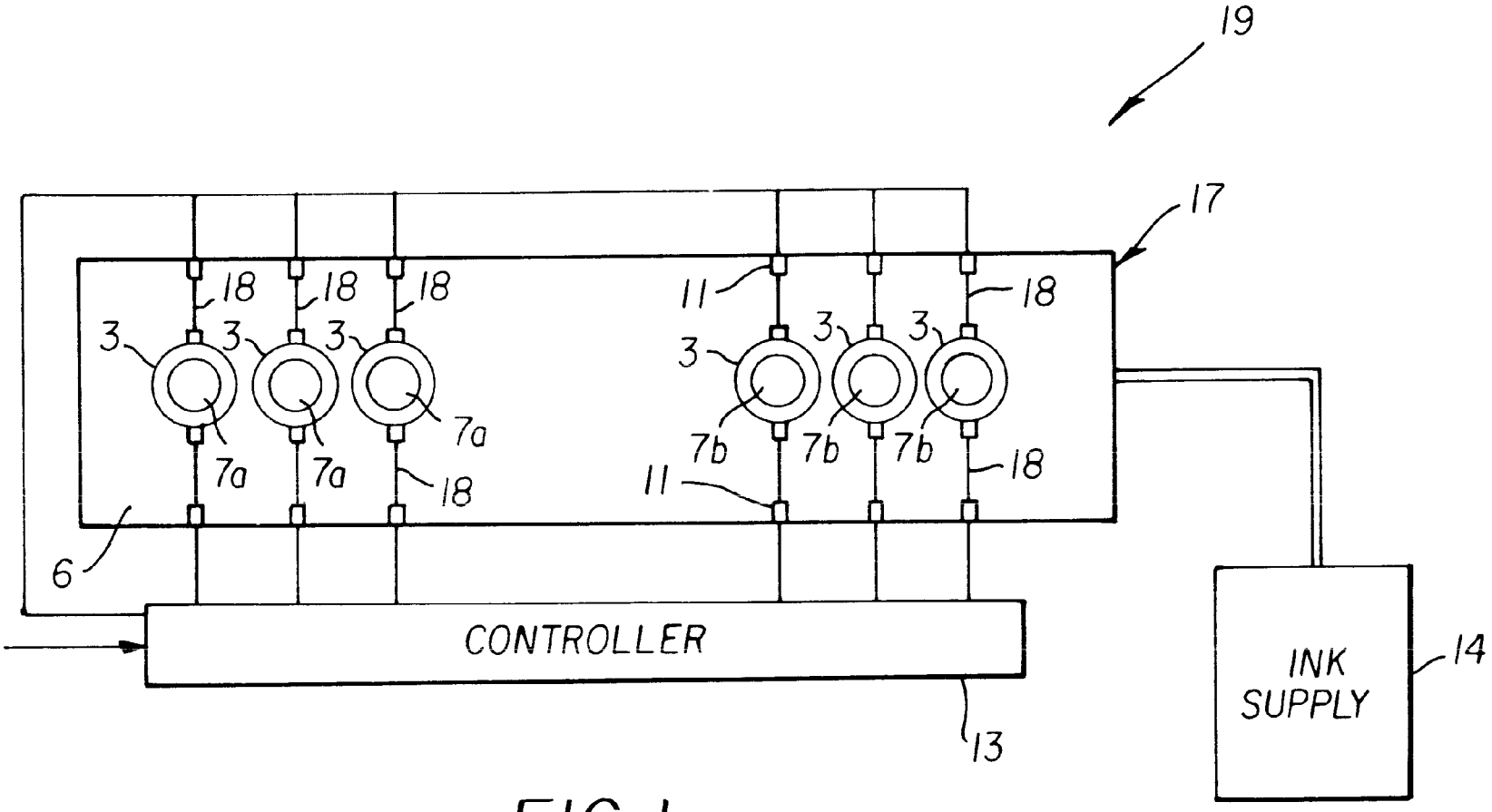
FIG. 1 is a schematic plan view of a print head made in accordance with a preferred embodiment of the present invention.

Referring to FIG. 1, an ink droplet forming mechanism 19 of a preferred embodiment of the present invention is shown. Ink droplet forming mechanism 19 includes a print head 17, at least one ink supply 14, and a controller 13. Although ink droplet forming mechanism 19 is illustrated schematically and not to scale for the sake of clarity, one of ordinary skill in the art will be able to readily determine the specific size and interconnections of the elements of a practical mechanism.

In a preferred embodiment of the present invention, print head 17 is formed from a semiconductor material (such as, for example, silicon) using known semiconductor fabrication techniques. Such known techniques include CMOS circuit fabrication, micro-electro mechanical structure (MEMS) fabrication, etc. However, it is specifically contemplated and, therefore within the scope of this disclosure, that print head 17 may be formed from any materials using any suitable fabrication techniques.

At least two nozzles are formed on print head 17 to constitute at least one group or cluster. For the purpose of illustration in FIG. 1, two groups 7*a* and 7*b* containing three nozzles each are shown. It must be considered that a group may consist of any number of nozzles greater than two, and that any number of groups can be incorporated within print head 17 and still be within the scope of this invention. The nozzles forming groups 7*a* and 7*b* are collectively and individually referred to herein by the reference numeral 7.

Nozzles 7 are in fluid communication with ink supply 14 through an ink passage (not shown) also formed in print head 17. It is specifically contemplated, therefore within the scope of this disclosure, that print head 17 may incorporate additional ink supplies in the manner of 14 and corresponding nozzles 7 in order to provide color printing using three or more ink colors. Single color printing may be accomplished using a single ink supply.

A heater 3 is at least partially formed or positioned on print head 17 around a corresponding nozzle 7. Although heaters 3 may be disposed radially away from an edge of the corresponding nozzle 7, heaters 3 are preferably disposed close to their corresponding nozzle 7 in a concentric manner. In a preferred embodiment, heaters 3 are formed in a substantially circular or ring shape. However, it is specifically contemplated, therefore within the scope of this disclosure, that heaters 3 may be formed in a partial ring, square, etc. Heaters 3 in a preferred embodiment consist principally of electric resistive heating elements electrically connected to electrical contact pads 11 via conductors 18.

Conductors 18 and electrical contact pads 11 may be at least partially formed or positioned on print head 17 and provide electrical connection between controller 13 and heaters 3. Alternatively, the electrical connection between controller 13 and heaters 3 may be accomplished in any well-known manner. Additionally, controller 13 may be a relatively simple device (a power supply for heaters 3, etc.) or a relatively complex device (logic controller, programmable microprocessor, etc.) operable to control many components (heaters 3, ink droplet forming mechanism 19, etc.) in a desired manner.

Print head 17 is able to create drops having a plurality of volumes. In the preferred implementation of this invention, larger drops are used for printing, while smaller drops are prevented from striking an image receiver. The creation of large ink drops for printing involves two steps. The first is the activation of the heater associated with a nozzle, activation being with an appropriate waveform to cause a jet of ink fluid to break up into droplets having a plurality of volumes. Secondly, droplets of a particular size range, originating from different nozzles 7, coalesce to form a larger printing drop.

Figure 2:
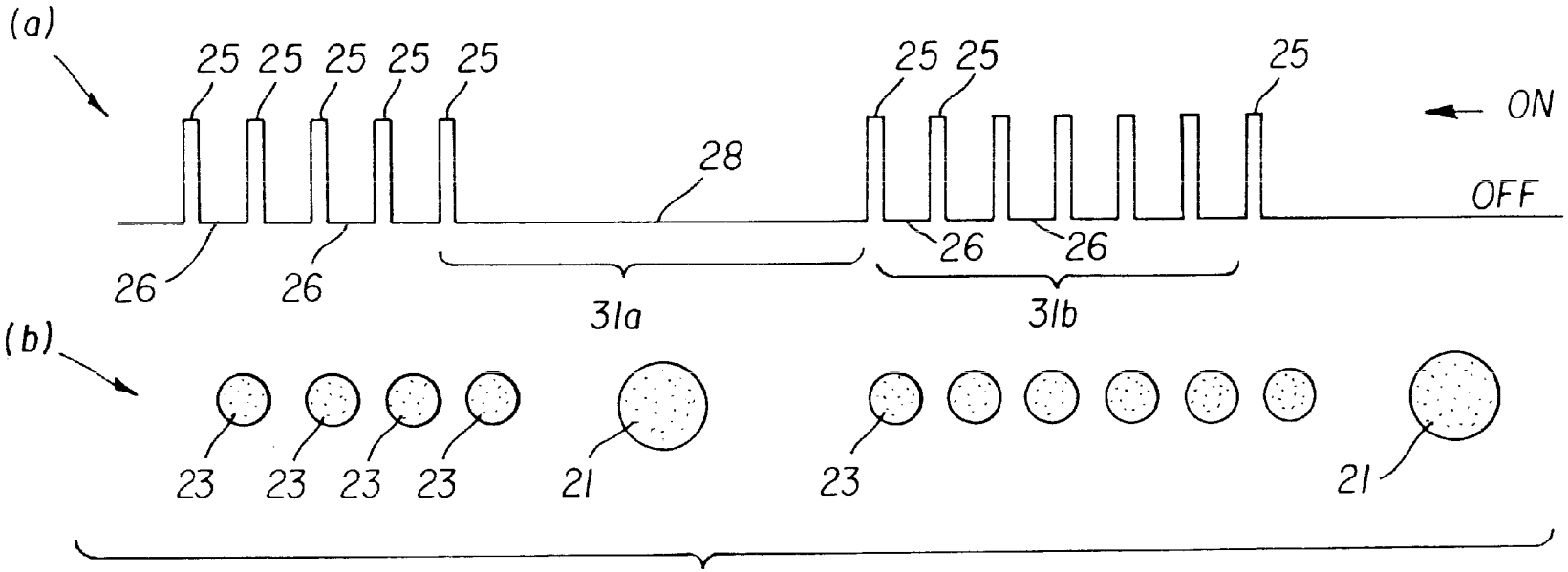
FIG. 2 is a diagram illustrating a frequency control of a heater used in the preferred embodiment of FIG. 1.

Considering the first step of droplet formation and referring to FIG. 2, an example of the electrical activation waveform provided by controller 13 to an individual heater 3 is shown generally as curve (a). The individual ink droplets 21 and 23 resulting from the jetting of ink from the corresponding nozzle, in combination with this heater actuation, are shown schematically in FIG. 2 as (b). A high frequency of activation of heater 3 results in small volume droplets 23, while a low frequency of activation of heater 3 results in large volume droplets 21. In a preferred implementation, during the time associated with the printing of an image pixel, one of two possible heater activation waveforms is issued according to whether printing or non-printing drops are required in accordance with image data. The waveform shown in pixel interval 31*b* is for the creation of a series of small non-printing drops 23, or the waveform shown in pixel interval 31*a* is used for creating one larger pre-printing drop 21.

Referring to curve (a) of FIG. 2, at the start of each pixel time interval, whether printing or non-printing drops are to be formed, heater 3 is activated by an electrical pulse 25. Electrical pulse 25 is typically from 0.1 to 10 microseconds in duration and more preferentially 0.5 to 1.5 microseconds. For the non-printing case, as in the waveform for pixel interval 31*b*, heater 3 is again activated after delay 26, with another pulse 25. This sequence of pulsing and delay is repeated for the duration of the pixel time. Delay time 26 is typically 1 to 100 microseconds, and more preferentially, from 3 to 6 microseconds. For the printing case, as in the waveform for pixel interval 31*a*, no further heater activation pulses are issued during delay time 28 for the remainder of the pixel time. Time delay 28 is chosen to be long relative to delay 26, so that the volume ratio of large, printing drops to small non-printing drops is preferentially a factor of 4 or greater.

Figure 3:
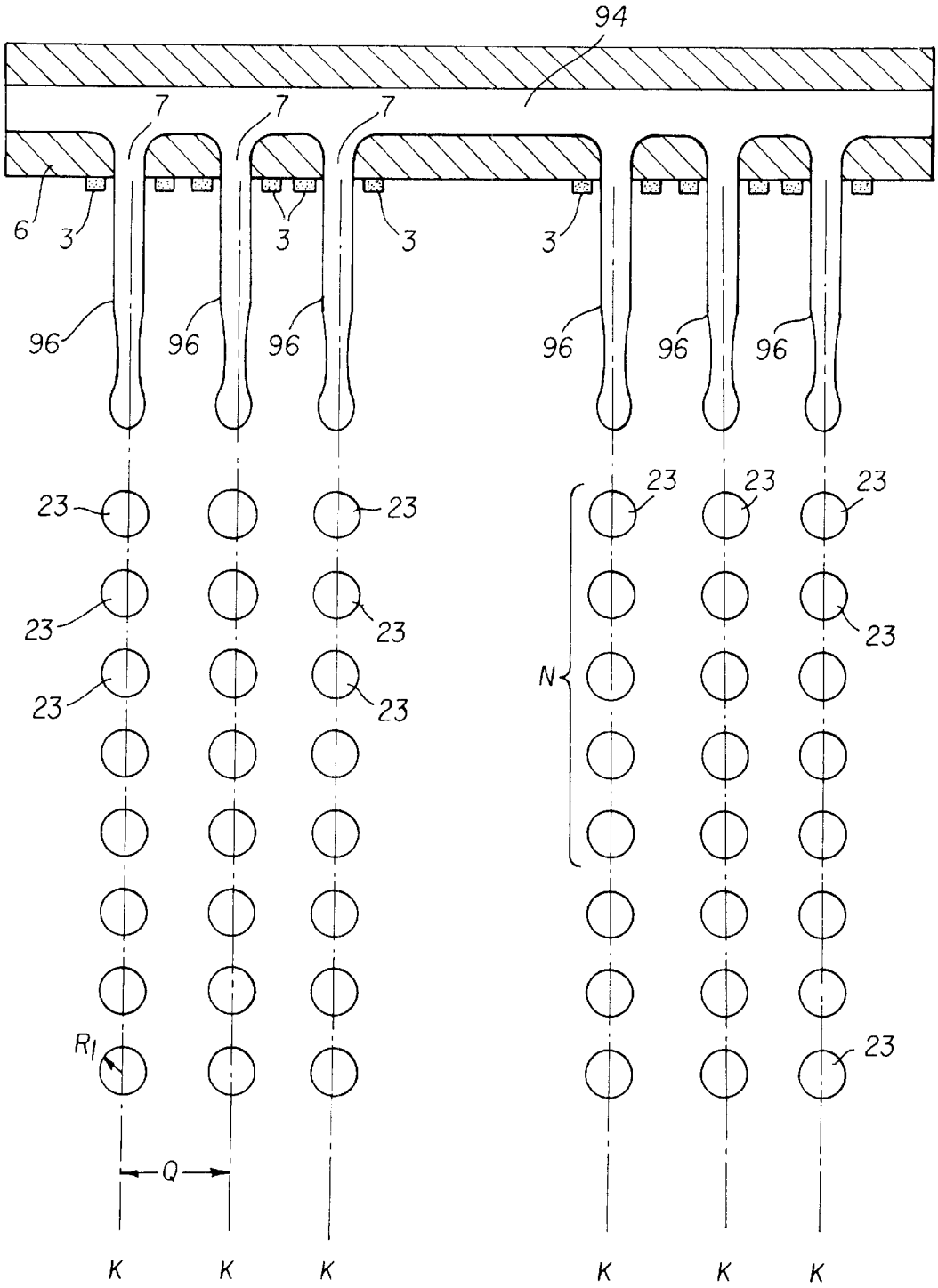
FIG. 3 is a schematic view of an ink jet printer made in accordance with the preferred embodiment of the present invention.

The coalescence step of printing drop formation is explained beginning with the schematic in FIG. 3 of a cross-section of print head 17 and associated ink jets of working fluid 96. Pressurized ink 94 from ink supply 14 is ejected through nozzles 7 along axes K, which are substantially perpendicular to the front surface of print head 17. Nozzles 7*a* are considered to be part of one physical grouping (a), and nozzles 7*b* constitute another group (b). The heaters 3 associated with nozzles 7*a* in group (a) are activated in a substantially similar manner, as are the nozzles 7*b* in group b. The example diagrammed in FIG. 3 is for heater 3 activation according to non-printing waveform associated with pixel interval 31*b*. Working fluid 96 breaks up into a uniformly sized series of small, non-printing drops 23 moving along axes K. Distance N represents the series of droplets that are formed during a pixel interval 31*b*. According to this implementation, the diameter, $R_1$, of the non-printing drops 23 is less than the distance, Q, between nozzles 7*a* in group (a), so that collisions between droplets originating from different nozzles 7 do not occur.

Figure 4:
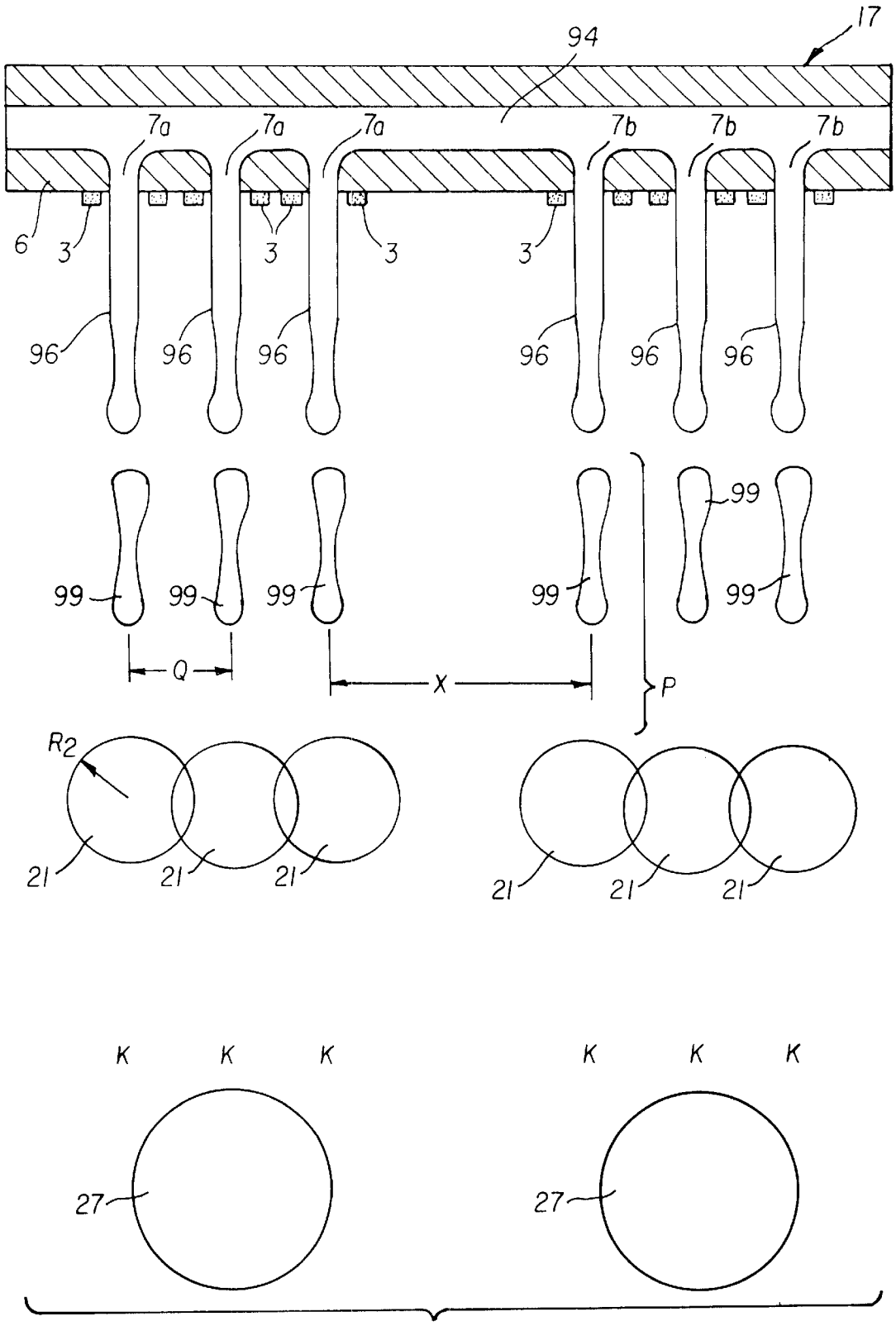
FIG. 4 is a cross-sectional view of an ink jet print head made in accordance with the preferred embodiment of the present invention.

The schematic of FIG. 4 shows a cross-section of print head 17 and associated jets of working fluid 96, in a similar way to FIG. 3, with the exception that heaters 3 are activated according to the printing waveform associated with pixel interval 31*a*. Working fluid 96 breaks up into fluidic columns 99, which then aggregate into spherical, pre-printing drops 21. According to this mode of droplet formation, the diameter, $R_2$, of pre-printing drops 21 is larger than the spacing, Q, between adjacent nozzles 7*a* in group (a), or the spacing between nozzles 7*b* in group (b). Because of the physical proximity of pre-printing drops 21 to each other (within a group), coalescence occurs, with the result that the larger, printing drop 27 is formed. The minimum spacing, X, of nozzles 7 between groups (a) and (b) is chosen to be greater than the diameter, $R_2$, of pre-printing drops 21, so that inter-group coalescence of pre-printing drops 21 does not occur.

Figure 6:
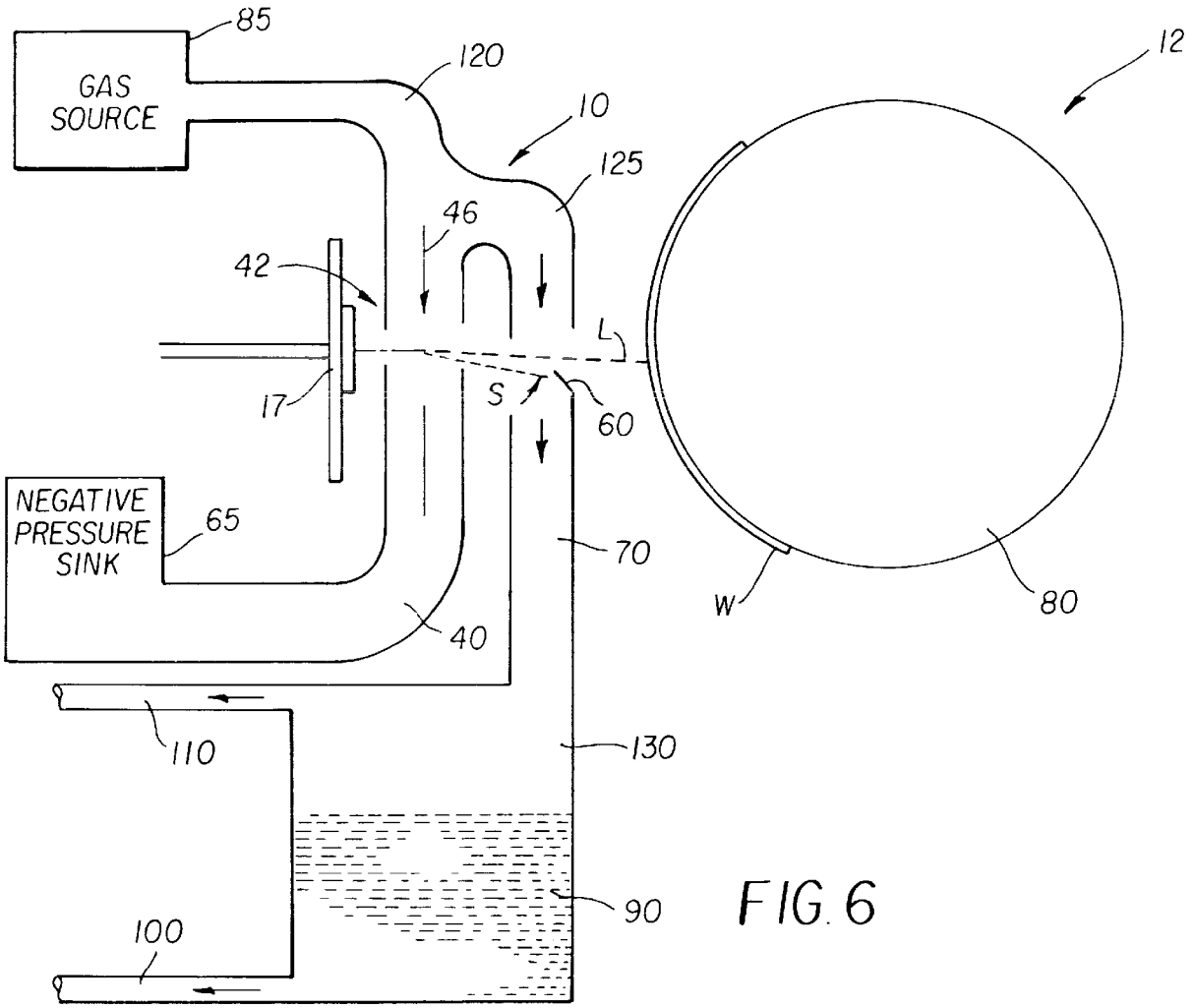
FIG. 6 is a schematic view of the jetting of ink from nozzle groups in a print head made in accordance with the preferred embodiment of the present invention, wherein droplet coalescence between jets occurs during the formation of large droplets.

It is apparent that heater 3 activation may be controlled independently by nozzle 7 groups, based on the ink color required and ejected through corresponding nozzle 7, movement of print head 17 relative to a print media W, shown in FIG. 6, and an image to be printed. The absolute volume of the small drops 23 and the large, pre-printing drops 21, and the number of nozzles 7 in a group, may be adjusted based upon specific printing requirements such as ink and media type or image format and size. As such, reference below to large, printing drops 27 and small, non-printing drops 23 is relative in context for example purposes only and should not be interpreted as being limiting in any manner.

Figure 5:
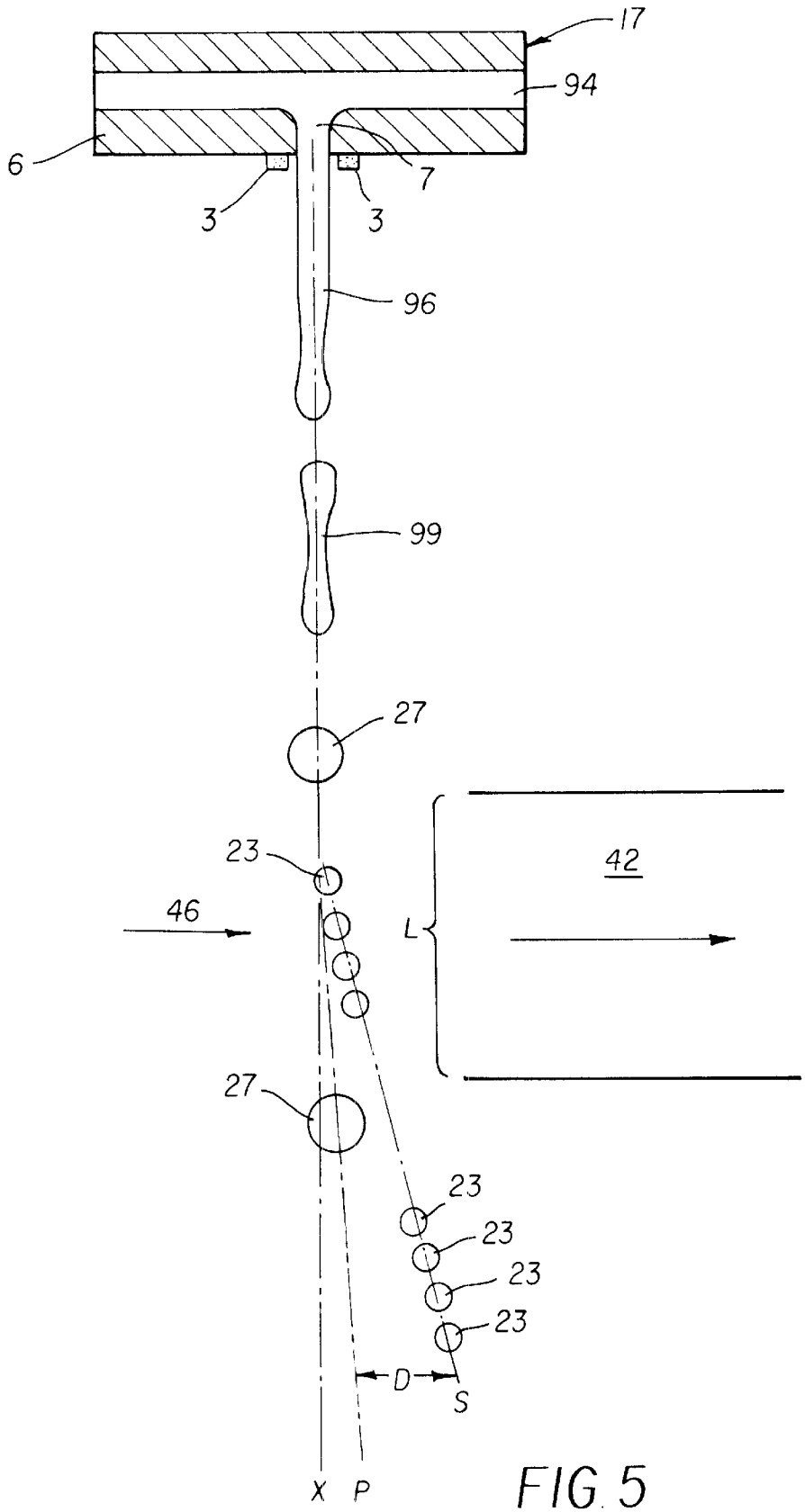
FIG. 5 is a schematic view of the jetting of ink from nozzle groups in a print head made in accordance with the preferred embodiment of the present invention, wherein droplet coalescence between jets does not occur during the formation of small droplets.

The operation of print head 17 in a manner such as to provide an image-wise modulation of drop volumes, as described above, is coupled with a discriminator (software, hardware, firmware, or a combination thereof) which separates droplets into printing or non-printing paths according to drop volume. Referring to FIG. 5, pressurized ink 94 from ink supply 14 is ejected through nozzle 7, which is one member of a group in print head 17, creating a filament of working fluid 96. Heater 3 is selectively activated at various frequencies according to image data, causing filament of working fluid 96 to break up into a stream of individual ink droplets. Intra-group coalescence of pre-printing drops 21 is assumed to occur, so at the distance from the print head 17 that the discriminator is applied, droplets are substantially in two size classes: small, non-printing drops 23 and large, printing drops 27. In the preferred implementation, the discriminator provides a force 46 of a gas flow in droplet deflector 42, perpendicular to axis X. Force 46 acts over distance L. Large, printing drops 27 have a greater mass and more momentum than small, non-printing drops 23. As gas force 46 interacts with the stream of ink droplets, the individual ink droplets separate depending on each droplet's volume and mass. Accordingly, the gas flow rate in droplet deflector 42 can be adjusted to provide sufficient differentiation D between the small droplet path S and the large droplet path P, permitting large, printing drops 27 to strike print media, not shown, while small non-printing drops 23 are deflected as they travel and are captured by a ink guttering structure described below.

With reference to a preferred embodiment, a negative gas pressure or gas flow at one end of droplet deflector 42 tends to separate and deflect ink droplets. An amount of differentiation between the large, printing drops 27 and the small, non-printing drops 23 (shown as D in FIG. 5) will not only depend on their relative size but also the velocity, density, and the viscosity of the gas at droplet deflector 42; the velocity and density of the large, printing drops 27 and small, non-printing drops 23; and the interaction distance (shown as L in FIG. 5) over which the large, printing drop 27 and the small, non-printing drops 23 interact with the gas flowing from droplet deflector 42 with force 46. Gases, including air, nitrogen, etc., having different densities and viscosities can also be used with similar results.

Large, printing drops 27 and small, non-printing drops 23 can be of any appropriate relative size. However, the droplet size is primarily determined by ink flow rate through nozzle 7 and the frequency at which heater 3 is cycled. The flow rate is primarily determined by the geometric properties of nozzle 7 such as nozzle diameter and length, pressure applied to the ink, and the fluidic properties of the ink such as ink viscosity, density, and surface tension. As such, typical ink droplet sizes may range from, but are not limited to, 1 to 10,000 picoliters.

Although a wide range of droplet sizes and nozzle groupings are possible, at typical ink flow rates, for a 12 micron diameter nozzle, 3 per group, large, printing drop 27 can be formed with a delay time 28 of about 50 microseconds, producing droplets of about 180 picoliters in volume. Small, non-printing droplets 23 can be formed by cycling heaters at a frequency of about 200 kHz producing droplets that are about 6 picoliters in volume. These droplets typically travel at an initial velocity of 10 m/sec. Even with the above droplet velocity and sizes, a wide range of differentiation D between large volume and small volume droplets is possible depending on the physical properties of the gas used, the velocity of the gas and the interaction distance L, as stated previously. For example, when using air as the gas, typical air velocities may range from, but are not limited to 100 cm/sec to 1000 cm/sec while interaction distances L may range from, but are not limited to, 0.1 to 10 mm.

Nearly all fluids have a non-zero change in surface tension with temperature. Heater 3 is therefore able to break up working fluid 96 into droplets, allowing print head 17 to accommodate a wide variety of inks, since the fluid breakup is driven by spatial variation in surface tension within working fluid 96, as is well known in the literature. The ink can be of any type, including aqueous and non-aqueous solvent based inks containing either dyes or pigments, etc. Additionally, plural colors or a single color ink can be used.

Referring to FIG. 6, a printing apparatus 12 (typically, an ink jet printer) made in accordance with the present invention is shown. Large, printing drops 27 and small, non-printing drops 23 are ejected from print head 17 substantially along ejection path X in a stream. A droplet deflector 42 applies a force (shown generally at 46) to ink drops 27 and 23 as they travel along path X. Force 46 interacts with ink drops 27 and 23 along path X, causing the ink drops 27 and 23 to alter course. As large, printing drops 27 have different volumes and masses from small, non-printing drops 23, force 46 causes small, non-printing drops 23 to separate from large, printing drops 27 with small, non-printing drops 23 diverging from path X along small droplet path S. While large, printing drops 27 can be slightly affected by force 46, large, printing drops 27 are only slightly deflected from path X to path P.

Droplet deflector 42 can include a gas source 85 that communicates with upper plenum 120 to provide force 46. Additionally, a vacuum conduit 40, coupled to a negative pressure sink 65 promotes laminar gas flow and increases force 46. Typically, force 46 is positioned at an angle with respect to the stream of ink droplets operable to selectively deflect ink droplets depending on ink droplet volume. Ink droplets having a smaller volume are deflected more than ink droplets having a larger volume.

Gas source 85 and upper plenum 120 also facilitate flow of gas through plenum 125. The end of plenum 125 is positioned proximate drop paths S and P. A recovery conduit 70 is disposed opposite the end of plenum 125 and promotes laminar gas flow while protecting the droplet stream moving along paths S and P from external air disturbances. An ink recovery conduit 70 contains a ink guttering structure 60 whose purpose is to intercept the path S of small, non-printing drops 23, while allowing large, printing drops 27, traveling along large drop path P, to continue on to the recording media W carried by print drum 80. Ink recovery conduit 70 communicates with ink recovery reservoir 90 to facilitate recovery of non-printed ink droplets by an ink return line 100 for subsequent reuse. Ink recovery reservoir contains open-cell sponge or foam 130 that prevents ink sloshing in applications where the print head 17 is rapidly scanned. A vacuum conduit 110, coupled to a negative pressure source (not shown) can communicate with ink recovery reservoir 90 to create a negative pressure in ink recovery conduit 70 improving ink droplet separation and ink droplet removal. In a preferred implementation, the gas pressure in droplet deflector 42, plenum 125, and in ink recovery conduit 70 are adjusted in combination with the design of ink recovery conduit 70 so that the gas pressure in the print head assembly near ink guttering structure 60 is positive with respect to the ambient air pressure near print drum 80. Environmental dust and paper fibers are thusly discouraged from approaching and adhering to ink guttering structure 60 and are additionally excluded from entering ink recovery conduit 70.

In operation, recording media W is transported in a direction transverse to axis X by print drum 80 in a known manner. Transport of recording media W is coordinated with movement of print mechanism 10 and/or movement of print head 17. This can be accomplished using controller 13 in a known manner. Print media W can be of any type and in any form. For example, the print media can be in the form of a web or a sheet. Additionally, print media W can be composed from a wide variety of materials including paper, vinyl, cloth, other large fibrous materials, etc. Any mechanism can be used for moving print head assembly 10 relative to the media, such as a conventional raster scan mechanism, etc.

Print head 17 can be formed using a silicon substrate 6, etc. Print head 17 can be of any size and components thereof can have various relative dimensions. Heater 3, electrical contact pad 11, and conductor 18 can be formed and patterned through vapor deposition and lithography techniques, etc. Heater 3 can include heating elements of any shape and type, such as resistive heaters, radiation heaters, convection heaters, chemical reaction heaters (endothermic or exothermic), etc. The invention can be controlled in any appropriate manner. As such, controller 13 can be of any type, including a microprocessor based device having a predetermined program, etc.

The ability to use any type of ink and to produce a wide variety of droplet sizes, separation distances, and droplet deflections (shown as S in FIG. 5) allows printing on a wide variety of materials including paper, vinyl, cloth, other fibrous materials, etc. The invention has very low energy and power requirements because only a small amount of power is required to form large, printing drops 27 and small, non-printing drops 23.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An ink jet printer comprising:

a print head having at least one group of nozzles from which a stream of ink droplets of adjustable volume are emitted;

a mechanism adapted to adjust the volume of the emitted ink droplets, said mechanism having a first state wherein the emitted droplets are of a predetermined small volume and a second state wherein the emitted droplets are of a predetermined large volume; and a controller adapted to selectively switch the mechanism between said first and its second states, said nozzles being spaced apart by a distance wherein ink droplets of said predetermined small volume from adjacent ones of said nozzles do not contact one another or coalesce, while ink droplets of said predetermined large volume from adjacent ones of said nozzles do contact one another and coalesce.

2. An ink jet printer as set forth in claim 1 wherein the group includes more than two nozzles.

3. An ink jet printer as set forth in claim 1 further comprising a droplet deflector which uses a flow of gas positioned at an angle greater than zero with respect to said stream of ink droplets, said droplet deflector being adapted to interact with said stream of ink droplets, thereby separating ink droplets of said predetermined small volume from coalesced ink droplets of said predetermined large volume.

4. An ink jet printer as set forth in claim 3, wherein said droplet deflector includes a recovery plenum positioned adjacent said stream of ink droplets operable to collect and remove ink droplets.

5. An ink jet printer as set forth in claim 1 wherein said mechanism adapted to adjust the volume of the emitted ink droplets includes a heater positioned proximate said nozzle, said heater being adapted to selectively create said ink droplets having small volume and said ink droplets having large volume.

6. An ink jet printer as set forth in claim 5 wherein said heater is operable to be selectively actuated at a plurality of frequencies thereby creating said stream of ink droplets having said plurality of volumes.

7. An ink jet printer as set forth in claim 1, further comprising a catcher having a surface operable to collect said ink droplets having another of said plurality of volumes.

8. An ink jet printer as set forth in claim 1 wherein said droplets are emitted substantially simultaneously from all the nozzles of the group.

9. An ink jet printer as set forth in claim 8 wherein said droplets emitted from the nozzles of a group at a particular moment are all of said predetermined small volume or of said predetermined large volume, depending on the state of the mechanism.

10. A method of ink jet printing using a print head having at least one group of nozzles from which a stream of ink droplets of adjustable are emitted; said method comprising the steps of:

adjusting the volume of the emitted ink droplets between a predetermined small volume and a predetermined large volume;

causing the emitted ink droplets of said predetermined large volume, from adjacent ones of said nozzles, to contact one another and coalesce; and preventing the emitted ink droplets of said predetermined small volume, from adjacent ones of said nozzles, from contacting one another or coalescing.

11. A method of ink jet printing as set forth in claim 10 further comprising the step of using a flow of gas positioned at an angle greater than zero with respect to said stream of ink droplets to interact with said stream of ink droplets.

12. A method of ink jet printing as set forth in claim 10 further comprising the step of separating ink droplets of said predetermined small volume from coalesced ink droplets of said predetermined large volume.

13. A method of ink jet printing as set forth in claim 10 further comprising the step of using a flow of gas positioned at an angle greater than zero with respect to said stream of ink droplets to interact with said stream of ink droplets, thereby separating ink droplets of said predetermined small volume from coalesced ink droplets of said predetermined large volume.

14. A method of ink jet printing as set forth in claim 10 wherein the step of adjusting the volume of the emitted ink droplets is effected by way of a heater positioned proximate said nozzle, said heater being adapted to selectively create said ink droplets having small volume and said ink droplets having large volume.

15. A method of ink jet printing as set forth in claim 10 wherein said droplets are emitted substantially simultaneously from all the nozzles of the group.

* * * * *